United States Patent [19]

Miscavage

[11] 4,003,579

[45] Jan. 18, 1977

[54] DART GAME SCOREBOARD

[75] Inventor: Raymond R. Miscavage, Somerville, Mass.

[73] Assignee: John T. McDonnell, Somerville, Mass. ; a part interest

[22] Filed: July 7, 1975

[21] Appl. No.: 593,266

[52] U.S. Cl. ..... 273/148 R; 35/62

[51] Int. Cl.[2] ..... F41J 3/02

[58] Field of Search ..... 273/148 R, 148 A, 102 B; 40/64 R, 122, 159; 35/26, 61, 62, 66

[56] References Cited

UNITED STATES PATENTS

| | | | |
|---|---|---|---|
| 1,068,621 | 7/1913 | Abraham | 40/64 R |
| 1,549,118 | 8/1925 | Harvey | 40/159 |
| 1,881,140 | 10/1932 | Settel | 35/66 |
| 1,979,005 | 10/1934 | Montanye | 40/64 R X |
| 3,603,592 | 9/1971 | Bury | 273/135 B |

FOREIGN PATENTS OR APPLICATIONS

| | | | |
|---|---|---|---|
| 580,598 | 9/1946 | United Kingdom | 35/26 |
| 19,774 | 10/1894 | United Kingdom | 273/148 R |

*Primary Examiner*—Anton O. Oechsle
*Attorney, Agent, or Firm*—Morse, Altman, Oates & Bello

[57] ABSTRACT

A scoreboard is provided for use primarily in scoring dart games. Typically, darts may be played in a number of different ways with each game having its own rules and scoring procedures and each requiring a different score board or sheet for each game. The present invention discloses a permanent, multi-purpose scoreboard having a hard transparent front wall providing a writing surface formed with a U-shaped center core defining a recess open along one edge to receive a set of score sheets, each representing a different game and printed with scoring indicia unique to each game. The board may be wallmounted with a grease pencil attached for keeping score on the transparent front wall. The various score sheets may be rearranged as desired depending upon the particular game to be played.

4 Claims, 4 Drawing Figures

DART GAME SCOREBOARD

BACKGROUND OF THE INVENTION

1. Field of the Invention

This invention relates generally to scoreboards and more particularly is directed towards a new and improved permanent, multi-purpose scoreboard used primarily for scoring dart games.

2. Description Of The Prior Art

Darts is a game that may be played in many different ways. Although all dart games involve a target and a group of throwing darts, the manner in which a game may be played and scored can be varied in many ways. Historically, the playing of darts has developed a number of different games each having a different name and rules as well as different scoring arrangements. Some of these scoring arrangements are relatively elaborate and, heretofore, the practice has been to use a blackboard to outline a scoring pattern according to the particular game being played. Because of the complexity in the scoring of some of these games the preparation of a score sheet on paper or on a blackboard consumes an undue amount of time and detracts from the enjoyment of the game.

Accordingly, it is an object of the present invention to provide a permanent scoreboard adapted for use primarily with dart games and having a number of different scoring cards that may be quickly and easily changed from one game to another. Another object of this invention is to provide a simple, reuseable, permanent scoreboard primarily for dart games and which has an integral writing surface separate from the scorecards so that the cards are not marked by scoring and may be re-used.

SUMMARY OF THE INVENTION

This invention features a universal scoreboard for use primarily in connection with the playing of dart games and comprising a rigid holder or frame having a hard, smooth, transparent front wall providing a writing surface, a C-shaped planar core connected to the rear face of the said front wall and a rear wall co-extensive with said front wall and attached to the back face of said core defining a rectangular recess open along one edge of said holder. Several different pre-printed scoring sheets or cards are removably mounted within the recess, allowing quick and easy interchange of the sheets according to the game to be played. Scoring is accomplished by writing with a grease pencil or the like on the transparent front wall with the appropriate scoring sheet positioned in view behind the writing surface. Additional scoring information of a permanent nature is provided on the core and is also visible behind the transparent front wall.

DETAILED DESCRIPTION OF THE PREFERRED EMBODIMENT

Figure 1:
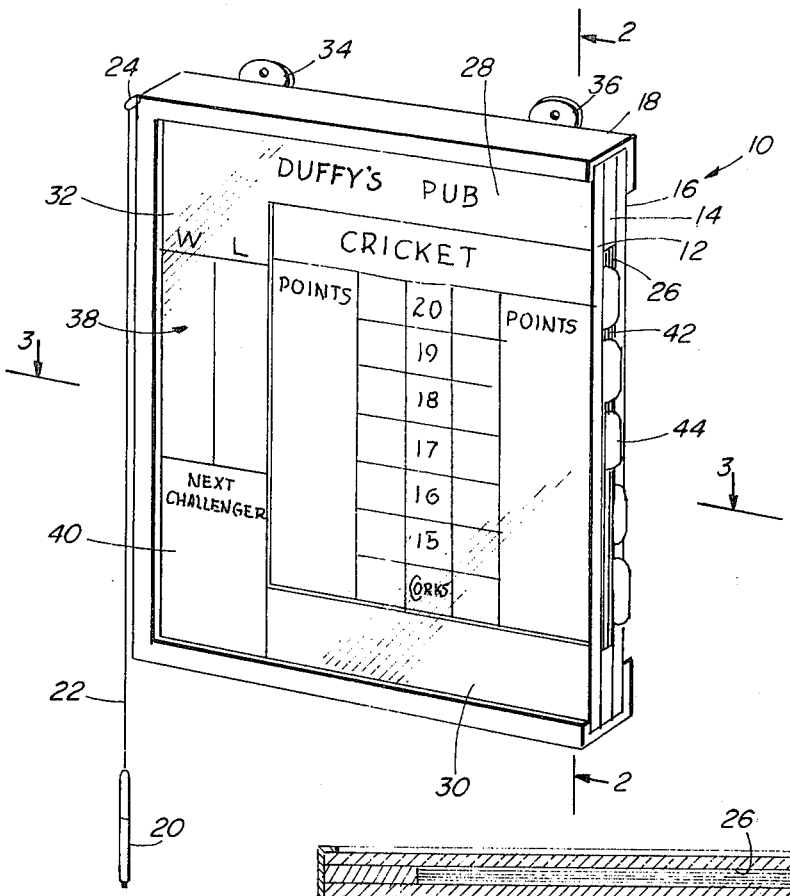
FIG. 1 is a view in perspective of a dart game scoreboard made according to the invention.
Figure 2:
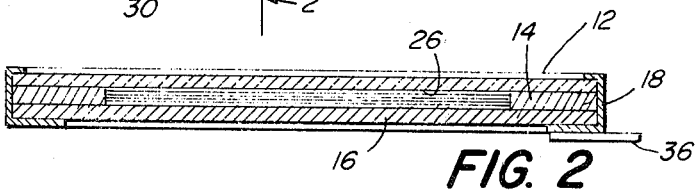
FIG. 2 is a cross-sectional view taken along the lines 2—2 of FIG. 1.
Figure 3:
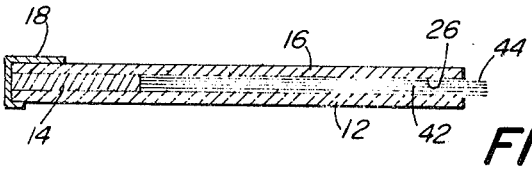
FIG. 3 is a cross-sectional view taken along the lines 3—3 of FIG. 1, and, FIG. 4 is a front elevation showing different scoring sheets used with the scoreboard.
Figure 4:
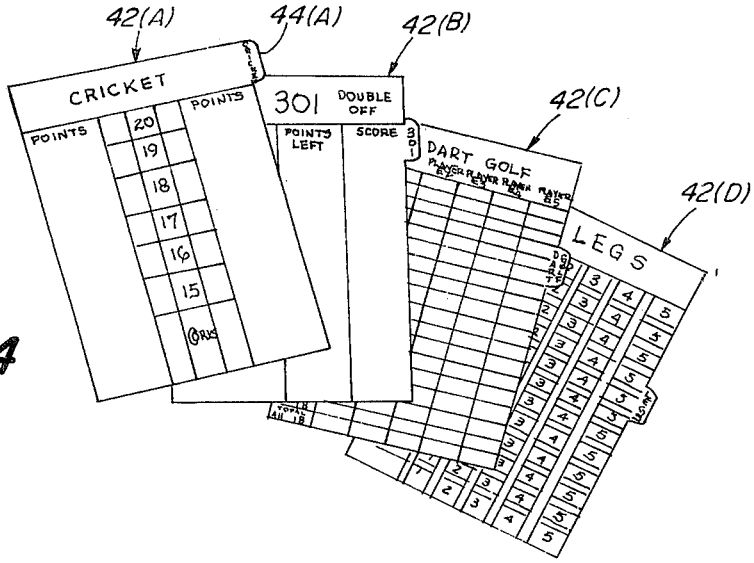

Referring now to the drawings, the reference character 10 generally indicates a scoreboard for use primarily in keeping the score of dart games that may take any one of a variety of different formats, each having different playing and scoring rules. The board 10 in the illustrated embodiment is a rectangular unit comprised of a front wall 12, a center core 14 and a rear wall 16 mounted in superimposed relation and rigidly connected to one another as by means of a marginal frame 18. The front wall 12 is of a rigid, transparent material, preferably ¼ inch clear glass, to provide a smooth, easily erasable writing surface on which the scorekeeper may write as by means of a grease pencil 20 conveniently attached to the frame 18 by means of a tether 22 and link 24. The glass wall 12 is rectangular, extending over substantially the full face of the board and is co-extensive with the back wall 16 which may be of any suitable rigid structural panel such as plywood, pressboard or the like.

The glass wall 12 is separated from the rear wall 16 by the core 14 which is of a C-shaped configuration to define a rectangular recess 26 between the front and rear wall open along the right-hand side edge of the board as viewed in FIG. 1. The core 14 is formed with parallel upper and lower horizontal portions 28 and 30 and a connecting vertical portion 32 defining the rectangular center opening which forms the recess 26 with the front and rear walls. In the illustrated embodiment, the front wall, core and rear wall are connected together by means of the frame 18 which is of a generally U-shaped cross-section and of a C-shaped outline corresponding to the marginal outline of the board. The frame is clipped over the edges of the assembled front wall, core and rear wall and the rear flange of the frame may be attached to the rear wall 16 by suitable means such as cement, staples or the like. Preferably, the frame 18 is fabricated from extruded aluminum or other material may be used to advantage. Pad eyes 34 and 36 are provided for hanging the board to an appropriate vertical support such as a beam, wall, door or the like.

The core 14, in the preferred embodiment, is printed with permanent scoring indicia which does not change from game to game and preferably this indicia is printed on the vertical portion 32 and comprised of won and loss columns 38 disposed above a box area 40 for listing the names of challengers in order. The upper and lower portions 28 and 30 may be pre-printed with advertising material or the like.

Removably mounted within the recess 26 is a group of different scoring cards 42 (a), (b), (c), etc., each pre-printed with different scoring indicia corresponding to the particular dart game to be played. All of the cards are rectangular and of equal size, each being formed with a tab 44 (a), (b), (c), etc., extending from side edge thereof out through the opening in the edge of the board to facilitate identification and removal of each card when changing games. Each card corresponds in size with the recess with a slight clearance to permit changing cards from time to time. The cards are changed by simply pulling out the appropriate card and moving it to the front of the group where the printed indicia may be viewed through the transparent front wall and the scorekeeper can write with the grease pencil opposite the appropriate scoring positions.

Each card is printed with the name of the game to be played such as "Cricket", "Dart Golf", "301", "501", "601" and the like. Typically, darts is played in 10 common games plus elimination games although many other games are available or may be developed.

Therefore, in practice, each board would be equipped with perhaps 10 different interchangeable scoring cards, each being printed with a different scoring format. The cards preferably are of a thin, stiff imprintable material such as cardboard or the like and are quickly and easily interchanged depending upon the game to be played. The arrangement allows the same scoring cards to be used repeatedly insofar as the writing is applied to the glass writing surface rather than on the card itself. After each game the scoring information is wiped off by a cloth, sponge or the like.

While the invention has been described with particular reference to the illustrated embodiment, numerous modifications thereto will appear to those skilled in the art. For example, the board may be made in a wide range of sizes as desired. The score sheets may be color coded in a range of colors to facilitate their selection. Grease pencils of any color may also be used.

Having thus described the invention what I claim and desire to obtain by Letters Patent of the United States is:

1. A scoreboard for dart games or the like, comprising, a. a rectangular front wall of hard transparent material and substantially constant thickness providing a writing surface on the outer face thereof, b. a C-shaped core of substantially constant thickness mounted to the inner face of said front wall in superimposed relation thereto, the dimensions of said core generally corresponding with those of said front wall, c. said core being formed with a rectangular reentrant open area along one side edge thereof and bearing on the front face thereof permanent dart scoring indicia visible through said front wall and an area for temporarily recording dart game results, d. a rectangular rear wall of substantially constant thickness coextensive with said front wall and mounted to the rear face of said core, e. means connecting said front wall, said core and said rear wall to form a board having an opening in one side edge thereof, and, f. a plurality of reprinted rectangular scoring cards removably mounted in said opening, each of a size generally corresponding in size and shape with said opening and each bearing a unique dart game scoring format for different dart games and areas visible through said front wall for recording dart game scores, g. each of said cards being formed with a tab along a side edge thereof for extending from said opening, said tabs being offset with respect to one another and of a length to extend visibly beyond the side edge of said front wall, said tabs being provided with indicia on the forward facing surfaces thereof related to the scoring formats on the associated cards.

2. A scoreboard according to claim 1 including mounting means connected to said board for mounting said board in an upright elevated position.

3. A scoreboard according to claim 1 wherein said front wall is glass.

4. A scoreboard according to claim 1 including a writing instrument adapted to write on said front wall, said instrument being tethered to said board.

* * * * *